United States Patent [19]

Hodes

[11] 4,045,212

[45] Aug. 30, 1977

[54] METHOD OF OPERATION OF A CUPOLA

[75] Inventor: Isidore Hodes, Farmington Hills, Mich.

[73] Assignee: General Motors Corporation, Detroit, Mich.

[21] Appl. No.: 658,477

[22] Filed: Feb. 17, 1976

[51] Int. Cl.[2] ..... C21B 11/00

[52] U.S. Cl. ..... 75/40; 75/41; 75/91; 75/92

[58] Field of Search ..... 75/40, 41, 42, 43, 91, 75/92; 266/219

[56] References Cited

U.S. PATENT DOCUMENTS

| | | | |
|---|---|---|---|
| 2,092,145 | 9/1937 | Wanner | 75/40 |
| 3,089,766 | 5/1963 | DeWald | 75/43 |
| 3,418,108 | 12/1968 | Von Stroh | 75/43 |
| 3,460,934 | 8/1969 | Kelmar | 75/42 |
| 3,630,719 | 12/1971 | Craig | 75/43 |
| 3,816,102 | 6/1974 | Celada et al. | 75/41 |

*Primary Examiner*—Walter R. Satterfield
*Attorney, Agent, or Firm*—Peter P. Kozak

[57] ABSTRACT

Conventional cupola apparatus and its operation are modified by suppressing the entrance of external air to the cupola and replacing the nitrogen component of the air injected into the conventional cupola with a recycled fraction of the cupola gas consisting substantially of CO and $CO_2$ withdrawn from the cupola at a point above the melting zone and replacing the oxygen component of the air with externally supplied substantially pure oxygen. The remaining fraction of the cupola gas is exhausted from the cupola system. When the cupola is thusly operated on a steady state basis, a balance is maintained so that the atomic amount of the oxygen exhausted from the system is equal to the atomic amount of the injected oxygen.

5 Claims, 2 Drawing Figures

METHOD OF OPERATION OF A CUPOLA

BACKGROUND OF THE INVENTION

The conventional cupola consists essentially of a furnace in the form of a shaft. At the bottom of the shaft is a well portion for collecting the melted metal and for initially receiving a bed charge of coke. Above the well but close thereto are tuyeres for feeding a relatively large volume of air under a relatively high pressure. In the upper portions of the shaft there is provided a charge door.

In conventional operation of the cupola the bed charge is first deposited and extends from the bottom of the well to a point above the tuyeres. The bed charge is ignited while air is injected through the tuyeres at a relatively low rate and maintained until the bed coke is red hot. Then the cupola is fully charged to the charge door sill with alternate layers of flux-containing coke and solid metal.

The air injection is then increased to a predetermined relatively high rate. In consequence the hot coke is further burned and the cupola portion in the immediate vicinity of the tuyeres forms an oxidation zone having a temperature of about 3200° F. The hot gasses now substantially $CO_2$ rise into the next layer of coke or reducing zone wherein some of the $CO_2$ is reduced to CO to form an atmosphere having a temperature of about 2400° to 2200° F. When this reducing gas rises to the metal layer, the metal is melted and trickles down into the well to form a pool therein which is tapped and conveyed to a suitable holding vessel outside the well. The flux, basically $CaCO_3$, combines with the silica and other ash and trickles down to form a slag layer over the molten metal. This slag layer is likewise tapped and periodically removed from the cupola.

The hot gases continue upward through successive layers of coke and metal to preheat these charges and to bring this zone to a temperature of about 1100° F. This exhaust gas which is principally nitrogen from the air, $CO_2$ and CO is discharged to the atmosphere. In the cupola operation described the sensible heat in the exhaust gas is lost. It has been proposed to divert at least a fraction of these cupola gases to preheat the air fed into the tuyeres using suitable heat exchanger before exhausting it to the atmosphere. It has also been proposed to provide a combustion chamber associated with the heat exchanger and to burn the CO is the cupola gas and hence to extract some of the heat of combustion as well as some of the sensible heat for practical use. It has also been proposed to inject enriching oxygen with the air into the cupola to increase the heating rate.

SUMMARY OF THE INVENTION

It is a principal object of my invention to eliminate the nitrogen component of the air which is normally injected through the tuyeres and used to support the combustion of the coke and to replace it with a recycled substantially nitrogen free fraction of the cupola gas consisting principally of CO and $CO_2$ and to supply substantially pure oxygen injected into the combustion zone with the recycled cupola gas in amounts comparable to the oxygen content of air to support the combustion of the coke. The remaining fraction of the cupola gas is expelled from the cupola system. When the operation of the cupola is established on a steady state basis, the atomic amount of oxygen expelled from the system and the atomic amount of incoming oxygen are balanced. Since the nitrogen proportion of the cupola gas expelled from the conventional cupola is in the neighborhood of 80%, the amount of recycled cupola gas in my cupola system is in a similar proportion and conversely the amount of gas expelled is about 20% of the total volume expelled in the conventional cupola, with marked heat saving.

Since substantially pure oxygen is the only gas fed into my cupola system after initial start up and represents about 20% of the air of the conventional cupola, the heat consumed in preheating the incoming gas is greatly reduced. Other advantages and objects will be apparent from the following description of preferred embodiments and from the drawings.

DESCRIPTION OF THE PREFERRED EMBODIMENTS

Figure 1:
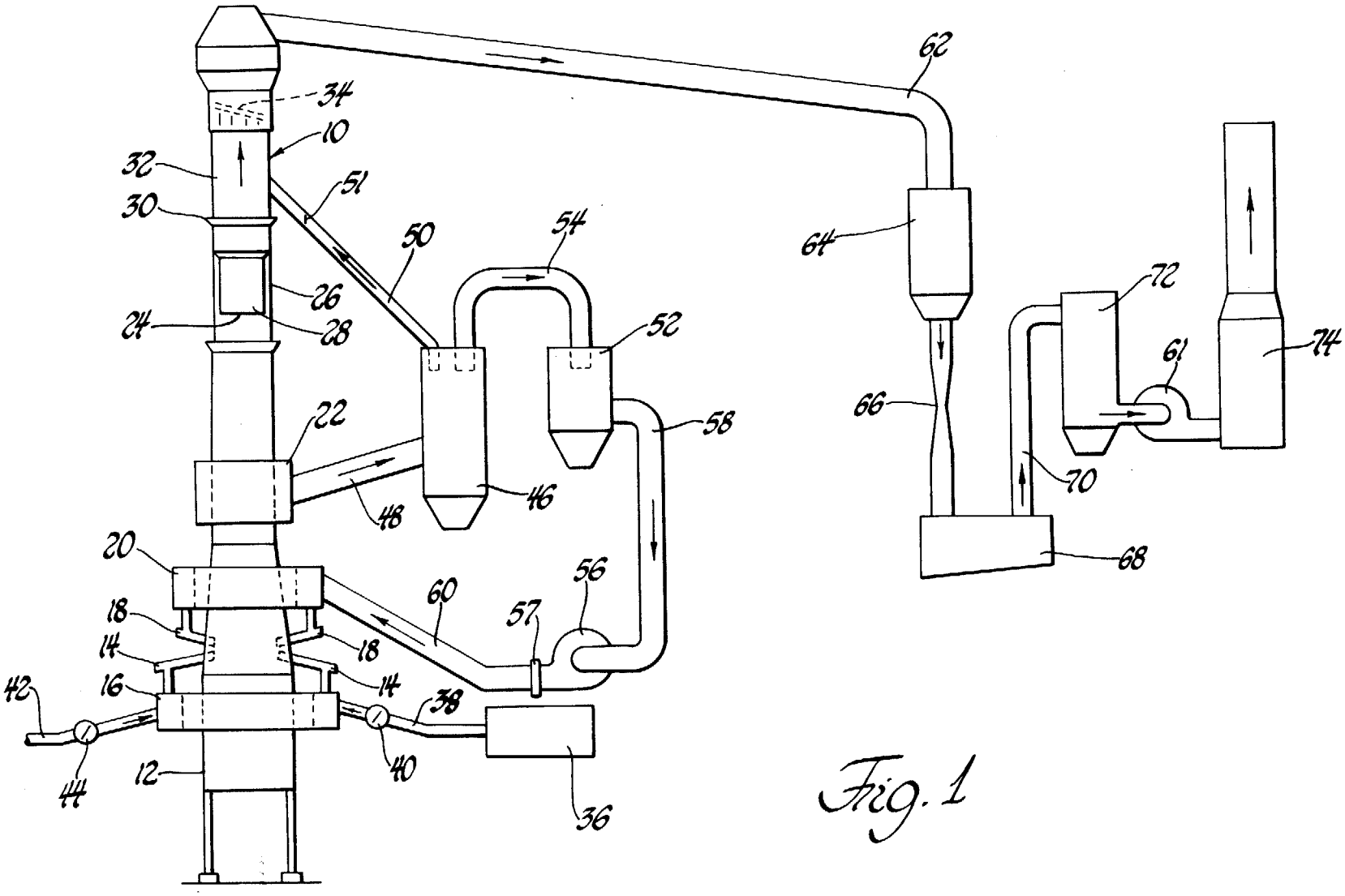
FIG. 1 is a schematic representation of the cupola system of my invention.

Referring to FIG. 1, my cupola system includes a cupola shaft 10 consisting of a steel shell suitably lined with a refractory including a well portion 12 at the bottom thereof, tuyeres 14 about the periphery of the stack and connected to an annular box 16 for supplying commercially pure oxygen or air to the tuyeres 14, and tuyeres 18 disposed about the periphery of the stack and connected to the annular box 20 for supplying recycled cupola gas to the combustion zone of the cupola. The oxygen or air tuyeres 14 and cupola gas tuyeres 18 are placed in approximately the same location as the air tuyeres of the conventional cupola.

An annular cupola gas box 22 is wrapped around the shaft 10 in the preheat zone thereof and communicates with the preheat zone by means of a plurality of openings (not shown) in and disposed about the periphery of the shell for recycling the cupola gas in accordance with the invention.

The cupola stack charge receiving portion terminates at the door sill 24. Above the door sill 24 is the charge door portion 26, including the charge door 28, which terminates in a closed ceiling 30. Above the ceiling 30 is the exhaust portion 32 of the shell preferably including the quencher apparatus 34 for cooling the cupola gas to be diverted from the cupola system through the cleaning apparatus described hereinafter.

Figure 2:
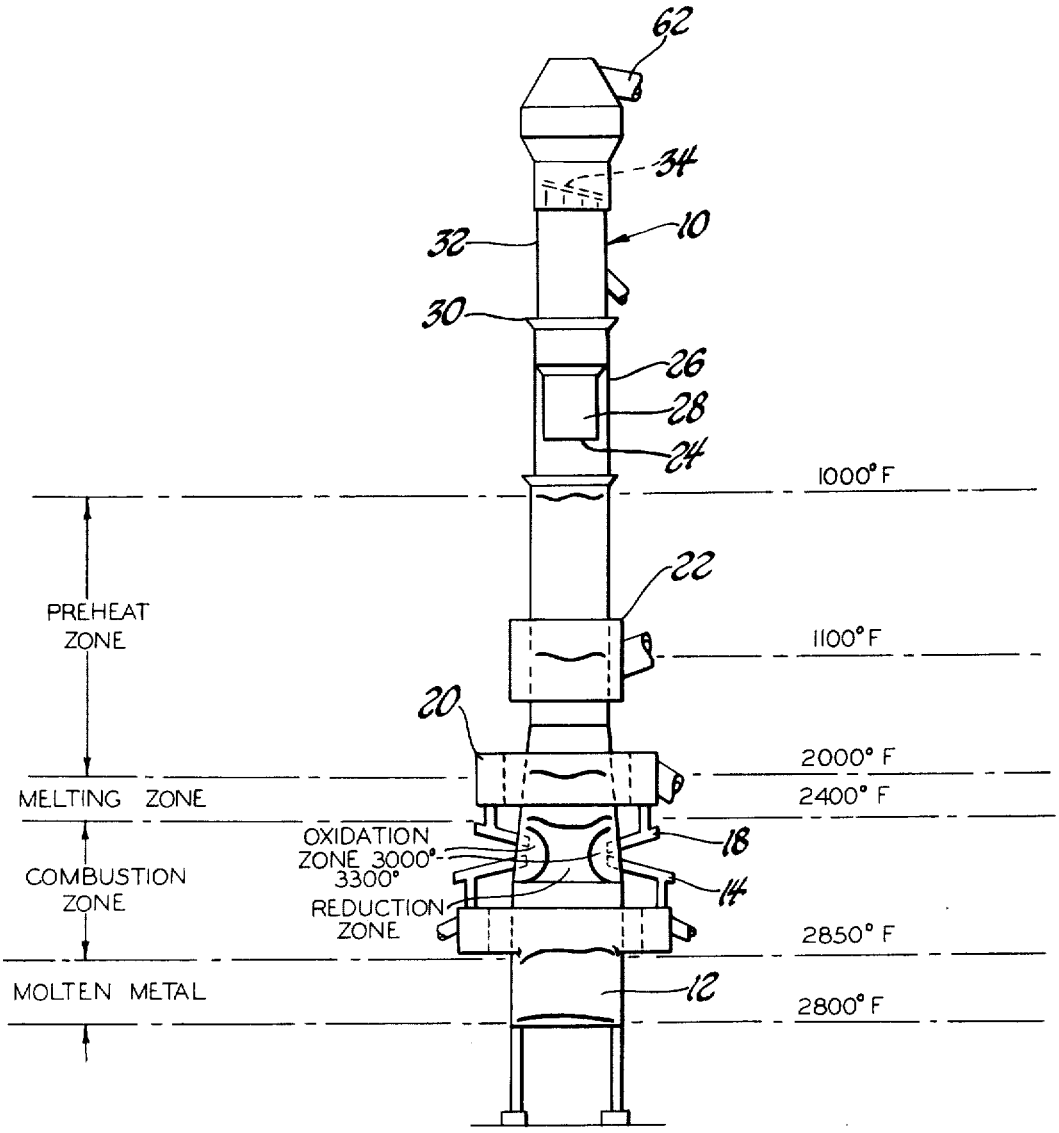
FIG. 2 shows the cupola or stack portion of FIG. 1 showing temperature and other cupola operating relationships.

FIG. 2 is the cupola shell 10 of FIG. 1 with the supporting apparatus broken away showing in general the temperature profile of a conventional cupola as well as of my cupola under steady state operating conditions. As shown, the lowermost zone includes the well 12 which receives the molten metal. Above the well is a hot coke region or combustion zone which extends up to several feet above the tuyeres and includes a donut shaped oxidation zone in the immediate vicinity of the tuyeres, and a reduction zone. Above the combustion and reduction zones is the melting zone. The remainder of the stack is the charge preheat zone. It should be understood that the dimensions of the zones are not necessarily to scale as shown but are intended to show relative relationships since actual operating conditions may vary considerably.

Referring again to FIG. 1, my cupola system includes an oxygen supply 36 leading to the oxygen box 16 by the conduit 38 through the valve 40. A second conduit 42 forms an air supply source (not shown) which leads to the oxygen box 16 through the valve 44.

The cupola gas take off box 22 is connected to drop out chamber 46 through the conduit 48. The heavy particulate in the gas drops out in this chamber. The exit or top end of the chamber 46 leads to the exhaust portion 32 of the cupola shell through a relative small conduit 50 containing the damper 51 and to a high efficiency centrifugal collector 52 through a relatively large conduit 54. The collector 52 in turn is connected to a recycle blower 56 through the conduit 58 and the blower outlet 57 is connected to the annular box 20 through the conduit 60. The collector 52 removes particles in sizes of 5 microns or larger and hence protects the blower 56 and the tuyeres 18 from abrasion.

The exhaust portion 32 of the cupola is connected to the exhaust blower 61 through the gas cleaning system including the conduit 62, the mist eliminator 64, the venturi 66, the water flooded elbow 68, the conduit 70 and the separator 72. The blower 61 exhausts into the stack 74 and thence out of the cupola system.

It may readily be seen that with the recycle blower 56 and the exhaust blower 61 in operation, the drop out chamber 46 is subjected to a partial vaccum at each of the conduits 50 and 54. In consequence the cupola gas box 22 is operative to draw cupola gas from the stack. A fraction of this gas is drawing into the collector 52 and thence through the blower 56 and forced into the annular box 20 and tuyeres 18. The remaining fraction of the cupola gas is drawn by the blower 61 into the exhaust stack 74 through the gas cleaning system described. The fraction of cupola gas recycled to the tuyeres and remaining fraction exhausted into the stack 74 are determined by the operating capacities of the blowers 56 and 61, the relative sizes of the conduits 50 and 54, venturi 66, the damper 51 and the other resistances encountered by the gas in the system. These may each be varied or modified to achieve the desired fractions. The recycle conduit 60 is kept low enough in cross sectional area so that the forward velocity of the recycle gas through it exceeds the backward burning velocity of the recycle gas which may be admixed with leakage air.

My cupola is started in a manner similar to that of a conventional cupola. The cupola is first partially filled with the bed charge (not shown). This charge is ignited and a relatively low pressure air blast is injected preferably through the oxygen tuyeres 14 from the air supply conduit 42. At this time of course the air valve 44 is open and the oxygen valve 40 is closed. Further the recycled blower 56 is shut down and the exhaust blower 61 is in operation to provide sufficient draft for igniting the coke bed. After the bed has become suitably red hot, successive charges of flux-containing (such as $CaCO_3$) coke and solid metal, such as iron and steel scrap mixed in suitable proportions to produce molten iron for casting are deposited in the shaft up to the door sill level 24. The air injection is then increased to a suitable high pressure so that the coke is further burned to reach a temperature of 3000° to 3300° F. in the vicinity of the tuyeres. The hot gas at the top of the combustion zone which is substantially all $CO_2$ rises into the overlying coke and is reduced partially to CO establishing a reducing environment. The gas rises further into the melting zone as indicated in FIG. 2 and begins to melt the metal. The hot gas continues to rise into and to fill the preheating zone. At this time, the air valve 44 is closed, the oxygen valve 40 is opened and the blower 56 is placed into operation all synchronously and progressively to cut off the air injection, to inject commercially pure oxygen in amounts substantially equal to the previous oxygen fraction of air and to recycle the cupola gas to substantially replace the nitrogen component of the air. When a steady state has been reached the temperature profile is the cupola shown in FIG. 2 is maintained and the atomic amount of oxygen leaving the cupola system through the stack 74 is equal to or balanced by the atomic amount of the oxygen injected at the tuyeres 14. If desired the oxygen may be mixed with the cupola recycle gas in proper proportions before entering the combustion chamber to provide a mixture comprising about 20% oxygen and 80% recycle cupola gas to achieve the normal melting rate.

As the metal charges are melted and molten iron collects in the well 12 of the cupola it is tapped or drained off through a suitable spout (not shown) in a manner well known in the art. The slag formed by the reaction of the flux with silica and other ash collects as a layer over the molten metal pool in the well and is likewise drawn of through a suitable spout (not shown).

Preferably the cupola gas take off box is located at a level along the preheat zone after the cupola gas has effectively preheated the charges below it, so as to take off the cupola gas at about a temperature of about 1200° to 1000° F. and preferably 1100° F. as shown in FIG. 2. Accordingly my invention not only avoids wasting the sensible heat in the recycle fraction of the cupola gas by exhausting it to the atmosphere as in the conventional cupola but eliminates the need to preheat the nitrogen since only the oxygen component need in effect be preheated. Further since the recycle gas is substantially moisture free, the need to dehumidify the gases injected into the combustion zone as is sometimes necessary when air is used, is avoided.

A feature of my invention is the cupola arrangement which is operative to suppress the inflow of nitrogen through the charge door. To this end the charge door is located sufficiently high above the gas take off box 22 so that the charges between the take off box 22 and the charge door effectively act as a plug therebetween. It is sufficient for the effective operation of my cupola system if the air influx to the take off box 22 from the charge door does not contribute more than about 1% of the recycle gas on a molar basis. If necessary the charge door may be suitably sealed to achieve this condition.

When it is desired to reduce the melting rate in the cupola, it is typical in the conventional a cupola to reduce or to spill the air blast. I prefer to reduce the melting rate in my cupola system by throttling the oxygen injection while continuing the recycle rate undiminished thereby impoverishing the gas mixture injected to support combustion. Similarly when it is desired to increase the melting rate, the oxygen injection may be increased while continuing the recycle rate undiminished thereby enriching the gas mixture injected to support combustion.

In another embodiment of this invention impoverishment and enrichment of the combustion supporting medium is achieved by increasing and reducing, respectively, the rate of cupola recycling while keeping the oxygen injection rate fixed. In still a third embodiment both the oxygen injection rate and the recycled gas injection rate are varied.

When it is desired to burn or shut down the cupola it is preferred to follow the procedure of charging only coke to the stack. The added coke suppresses the air influx to the preheat zone of the stack. When all the metal has been melted, the oxygen injection and cupola gas recycling are stopped completely. The cupola is then permitted to cool and the remaining coke in the stack is dropped from the cupola through the bottom doors.

Since the recycle gas taken off the cupola by the box 22 is almost completely free of nitrogen after the cupola is operating in accordance with my invention and is almost totally a mixture of $CO_2$ and CO provided by the combustion, one mole of the injected oxygen produces between one and two moles of new cupola gas, the exact amount depending on the relative amounts of $CO_2$ and CO formed. As previously stated the fraction of cupola gas diverted or exhausted to the atmosphere through the stack 74 is maintained at an amount such as to balance the cupola gas being newly generated from the entering oxygen. I prefer to limit the exhaust amount to about 1.2 times the oxygen consumed in the combustion zone, thus providing an improvement over a conventional cupola where oxygen is supplied as a component of air which requires that a volume of at least 4.76 times the oxygen consumed be exhausted. In my cupola system the completeness of burning the coke or fuel to $CO_2$ is enhanced by suppressing any significant influx or nitrogen through the charge door as previously described or from elsewhere. Accordingly combustion efficiency and melting capacity of the cupola in increased compared to the conventional cupola. The need for flux to slag ash and the sulfer pick up in the melted metal are both decreased.

I have estimated that compared to a conventional air operated cupola the need for preheat fuel, gas or oil in my cupola is eliminated. The volume of effluent gas discharged to the atmosphere, which is difficult to clean, is reduced over 75%. Coke usuage is reduced about 30% and slag volume is reduced about 25%. Accordingly, the melting capacity is increased about 40%.

Although my invention has been described in terms of certain specific embodiments it will be obvious to those skilled in the art that other embodiments and variations may be adopted within the spirit and scope of the invention.

What is claimed is:

1. A method of operating a cupola system having alternate layers of coke and metal to be melted arranged in a stack and having a combustion zone near the bottom of the stack and progressively upward along the stack a reducing zone, a melting zone and a preheat zone, comprising continuously introducing substantially pure oxygen into said combustion zone and continuously recycling a fraction of the cupola gas from said preheat zone to said combustion zone and exhausting from said cupola system the remaining fraction of said cupola gas, the rate of oxygen flow into said combustion zone and the fraction of cupola gas exhausted being balanced so that the amount of said pure oxygen introduced into said combustion zone is substantially equal to the amount of the oxygen in said remaining fraction, said pure oxygen being the only gas fed into said cupola system after the system is started in operation.

2. In a method of operating a cupola system of the type comprising alternate layers of coke and metal to be melted arranged in a stack and having a combustion zone near the bottom of the stack, a reducing zone, a melting zone, a preheat zone and an exhaust conduit for conveying cupola gas from said cupola system comprising subjecting the coke in said combustion zone to an air blast to produce $CO_2$ gas which is subsequently at least partially reduced to CO in accordance with $CO_2 + C = 2CO$ in said reducing zone to constitute said cupola gas and then passed upward in said stack through said melting zone and into said preheat zone, then progressively returning an increasing fraction of said cupola gas from said preheat zone to said combustion zone and simultaneously progressively reducing the amount of said air blast to said combustion zone, simultaneously progressively injecting substantially pure oxygen to said combustion zone and progressively expelling the remaining fraction from said system so as to keep the rate of oxygen injected into said combustion zone and the amount of cupola gas expelled from said system balanced so that the amount of said pure oxygen injected into said combustion zone is substantially equal to the amount of the oxygen removed from the system, then continuing to inject only substantially pure oxygen into said combustion zone, to return a fraction of said cupola gas from said preheat zone to said combustion zone and to remove cupola gas from said system in accordance with the said balance.

3. In a method of operating a cupola system of the type comprising alternate layers of coke and metal to be melted arranged in a stack and having a combustion zone near the bottom of the stack, a reducing zone, a melting zone, a preheat zone and an exhaust conduit for conveying cupola gas from said cupola system comprising, subjecting the coke in said combustion zone to an air blast to produce $CO_2$ gas which is subsequently at least partially reduced to CO in accordance with $CO_2 + C = 2CO$ in said reducing zone to constitute said cupola gas and then passing said cupola gas upwardly in said stack through said melting zone and into said preheat zone, then progressively returning an increasing fraction of said cupola gas from said preheat zone to said combustion zone and simultaneously progressively reducing the amount of said air blast to said combustion zone, simultaneously progressively injecting substantially pure oxygen to said combustion zone and progressively expelling the remaining fraction from said system so as to keep the rate of oxygen injected into said combustion zone and the amount of cupola gas expelled from said system balanced so that the amount of said pure oxygen injected into said combustion zone is substantially equal to the amount of the oxygen removed from the system, then continuing to inject only substantially pure oxygen into said combustion zone, to return a fraction of said cupola gas from said preheat zone to said combustion zone and to remove cupola gas from said system in accordance with said balance to thereby maintain a steady melting rate, then selectively varying the rate of oxygen or of recycled gas, or of both, injected into said combustion zone to vary the melting rate and removing cupola gas from said system in accordance with said balance.

4. In a method of operating a cupola system of the type comprising alternate layers of coke and metal to be melted arranged in a stack and having a combustion zone near the bottom of the stack, a reducing zone, a melting zone, a preheat zone and an exhaust conduit for conveying cupola gas from said cupola system comprising, subjecting the coke in said combustion zone to an air blast to produce $CO_2$ gas which is subsequently at least partially reduced to CO in accordance with $CO_2 + C = 2CO$ in said reducing zone to constitute said cupola gas and then passing said cupola gas upwardly in said stack through said melting zone and into said preheat zone, then progressively returning a fraction of the cupola gas from said preheat zone to said combustion zone and simultaneously progressively reducing the amount of said air blast to said combustion zone, simultaneously progressively injecting sustantially pure oxygen to said combustion zone and progressively expelling the remaining fraction from said system so as to keep the rate of oxygen expelled into said combustion zone and the amount of capula gas removed from said system balanced so that the amount of said pure oxygen injected into said combustion zone is substantially equal to the amount of the oxygen removed from the system, p1 then continuing to inject only substantially pure oxygen into said combustion zone, to return a fraction of said cupola gas from said preheat zone to said combustion zone and to remove cupola gas from said system in accordance with said balance to thereby maintain a steady melting rate, then continuing to charge only coke to said stack to suppress influx of air into said stack until all the metal has melted and then stopping the injection of the oxygen and then recycling said cupola gas to shut down said cupola.

5. In a method of operating a cupola system of the type comprising alternate layers of coke and metal to be melted arranged in a stack and having a combustion zone near the bottom of the stack, a reducing zone, a melting zone, a preheat zone and an exhaust conduit for conveying cupola gas from said cupola system comprising subjecting the coke in said combustion zone to an air blast at an initial flow rate to produce $CO_2$ gas which is subsequently at least partially reduced to CO in accordance with $CO_2 + C = 2CO$ in said reducing zone to constitute said cupola gas and then passed upward in said stack through said melting zone and into said preheat zone, then progressively reducing the amount of said air blast to said combustion zone from said initial flow rate until the air is completely shut off while sumultaneously synchronously and progressively injecting increasing amounts of substantially pure oxygen to said combustion zone until the rate of injection of said oxygen is substantially equivalent to the rate of flow of oxygen at the initial flow rate of said air blast and recycling cupola gas from said preheat zone to said combustion zone until the rate of recycled cupola gas is substantially equivalent to the rate of flow of nitrogen at the initial flow rate of said air blast, and thereafter continuing to inject substantially pure oxygen into said combustion zone and to recycle said cupola gas into said combustion zone at their respective said rates while exhausting cupola gas from said cupola system at a rate such that the amount of oxygen in said exhaust is substantially equivalent to the amount of pure oxygen injected, said oxygen being the only gas fed into said cupola system after said air is shut off.

* * * * *